US006622460B2

(12) United States Patent
Gregory

(10) Patent No.: US 6,622,460 B2
(45) Date of Patent: Sep. 23, 2003

(54) TAMPER-INDICATING CLOSURE WITH LUGS ON A STOP FLANGE FOR SPACING THE FLANGE FROM THE FINISH OF A CONTAINER

(75) Inventor: James L. Gregory, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 30 days.

(21) Appl. No.: 10/054,431

(22) Filed: Jan. 22, 2002

(65) Prior Publication Data

US 2002/0062626 A1 May 30, 2002

Related U.S. Application Data

(62) Division of application No. 09/301,065, filed on Apr. 28, 1999, now Pat. No. 6,382,443.

(51) Int. Cl.[7] ..... B65B 7/28

(52) U.S. Cl. ..... 53/490; 53/420; 53/485; 53/317; 53/331.5; 215/252; 215/258; 215/331

(58) Field of Search ..... 53/420, 485, 490, 53/317, 331.5; 215/252, 329, 330, 331, 258

(56) References Cited

U.S. PATENT DOCUMENTS

| | | | |
|---|---|---|---|
| 3,295,708 | A | 1/1967 | Wathen, Jr. |
| 3,297,184 | A | 1/1967 | Andelin |
| 3,329,295 | A | 7/1967 | Fields |
| 3,374,913 | A | 3/1968 | Zipper |
| 3,438,528 | A | 4/1969 | Fields |
| 3,484,012 | A | 12/1969 | White et al. |
| 3,682,345 | A | 8/1972 | Baugh |
| 3,784,041 | A | 1/1974 | Birch |
| 3,858,743 | A | 1/1975 | Mumford |
| 3,861,551 | A | 1/1975 | Hannon |
| 4,125,201 | A | 11/1978 | Birch |
| 4,126,240 | A | 11/1978 | Brach |
| 4,147,268 | A | 4/1979 | Patel et al. |
| 4,157,144 | A | 6/1979 | Weiler et al. |
| 4,196,818 | A | 4/1980 | Brownbill |
| 4,206,851 | A | 6/1980 | Ostrowsky |
| 4,291,813 | A | 9/1981 | Allen et al. |
| 4,305,516 | A | 12/1981 | Perné et al. |
| 4,322,009 | A | 3/1982 | Mumford |
| 4,325,487 | A | 4/1982 | Libit |

(List continued on next page.)

FOREIGN PATENT DOCUMENTS

| | | | |
|---|---|---|---|
| AU | 650056 | 3/1992 | ..... 215/252 |
| DE | 2213773 | 3/1972 | |
| DE | 3025751 | 2/1982 | |

(List continued on next page.)

*Primary Examiner*—John Sipos
*Assistant Examiner*—Louis Huynh

(57) ABSTRACT

A tamper-indicating closure of integrally molded plastic construction that includes a base wall having a peripheral skirt with internal threads for engaging external threads on a container finish. A tamper-indicating band is connected to the edge of the skirt by a plurality of circumferentially spaced integral frangible bridges. A stop flange extends axially outwardly and radially inwardly from an edge of the band remote from the skirt for inversion and engagement with a bead on the container finish. The stop flange is in the form of a circumferentially continuous base of uniform thickness circumferentially of the band, and either uniform or increasing thickness radially and axially of the band. A plurality of circumferentially spaced lugs are integral with and extend from the base. The lugs widen uniformly from zero thickness at the band to a maximum thickness at the free edge of the flange. The lugs are thus disposed for opposed abutting engagement with the A1 diameter of the container finish beneath the A bead on the container finish. The channels or serrations between the lugs permit drainage of liquid from the area between the skirt and the container finish.

13 Claims, 3 Drawing Sheets

U.S. PATENT DOCUMENTS

| | | | | | |
|---|---|---|---|---|---|
| 4,349,116 | A | | 9/1982 | Luenser | |
| 4,394,918 | A | | 7/1983 | Grussen | |
| 4,401,227 | A | | 8/1983 | Pehr | |
| 4,432,461 | A | | 2/1984 | Mumford et al. | |
| 4,458,821 | A | | 7/1984 | Ostrowsky | |
| 4,458,822 | A | | 7/1984 | Ostrowsky | |
| 4,470,513 | A | | 9/1984 | Ostrowsky | |
| 4,478,343 | A | | 10/1984 | Ostrowsky | |
| 4,506,795 | A | | 3/1985 | Herr | |
| 4,576,298 | A | | 3/1986 | Boik | |
| 4,592,475 | A | | 6/1986 | Hannon et al. | |
| 4,651,886 | A | | 3/1987 | Stull | |
| 4,653,657 | A | | 3/1987 | Papavasilopoulos | |
| 4,657,153 | A | | 4/1987 | Hayes | |
| 4,721,218 | A | | 1/1988 | Gregory et al. | |
| 4,801,031 | A | | 1/1989 | Barriac | |
| 4,875,594 | A | | 10/1989 | Ochs | |
| 4,895,266 | A | | 1/1990 | Begley | |
| RE33,265 | E | | 7/1990 | Gregory et al. | |
| 4,978,016 | A | | 12/1990 | Hayes | |
| 4,981,230 | A | | 1/1991 | Marshall et al. | |
| 5,007,545 | A | | 4/1991 | Imbery, Jr. | |
| 5,050,753 | A | | 9/1991 | Trump et al. | |
| 5,054,268 | A | * | 10/1991 | Hayes et al. | 53/490 |
| 5,058,755 | A | | 10/1991 | Hayes | |
| 5,062,538 | A | | 11/1991 | Ochs | |
| 5,129,530 | A | | 7/1992 | Fuchs | |
| 5,257,705 | A | | 11/1993 | de Santana | |
| 5,271,512 | A | | 12/1993 | Ekkert | |
| 5,282,540 | A | | 2/1994 | Beck | |
| 5,356,020 | A | | 10/1994 | Thompson | |
| 5,400,913 | A | | 3/1995 | Kelly | |
| 5,462,187 | A | | 10/1995 | Gregory et al. | |
| 5,472,106 | A | | 12/1995 | Nofer | |
| 5,479,762 | A | * | 1/1996 | Bliss | 53/490 |
| 5,488,888 | A | | 2/1996 | Kowal | |
| 5,522,293 | A | | 6/1996 | Ingram | |
| 5,547,092 | A | | 8/1996 | Thompson | |
| 5,564,319 | A | | 10/1996 | Kowal | |
| 5,570,798 | A | | 11/1996 | Hayashida et al. | |
| 5,650,113 | A | | 7/1997 | Gregory et al. | |
| 5,678,714 | A | | 10/1997 | Guglielmini | |
| 5,685,443 | A | | 11/1997 | Taber et al. | |
| 5,725,115 | A | | 3/1998 | Bösl et al. | |
| 5,727,705 | A | | 3/1998 | Kelly | |
| 5,755,347 | A | | 5/1998 | Ingram | |
| 5,775,527 | A | | 7/1998 | Bösl et al. | |
| 5,813,553 | A | | 9/1998 | Herr et al. | |
| 5,816,029 | A | * | 10/1998 | Sweeny | 53/490 |
| 5,913,437 | A | | 6/1999 | Ma | |
| 6,006,930 | A | | 12/1999 | Dreyer et al. | |
| 6,085,921 | A | | 7/2000 | Brown | |
| 6,116,442 | A | | 9/2000 | Higgins | |
| 6,119,883 | A | | 9/2000 | Hock et al. | |
| 6,152,316 | A | | 11/2000 | Niese | |
| 6,253,940 | B1 | | 7/2001 | Graham et al. | |
| 6,381,928 | B1 | * | 5/2002 | Gregory | 53/485 |
| 6,382,443 | B1 | * | 5/2002 | Gregory | 215/252 |

FOREIGN PATENT DOCUMENTS

| | | |
|---|---|---|
| DE | 4108453 | 10/1991 |
| EP | 0049876 | 4/1982 |
| EP | 0447021 | 9/1991 |
| FR | 2291915 | 11/1974 |
| FR | 2421812 | 11/1979 |
| FR | 2723571 | 2/1996 |
| GB | 20346574 | 6/1980 |
| JP | 57126340 | 1/1956 |
| JP | 61244757 | 10/1985 |
| JP | 62146162 | 5/1987 |
| JP | 4215964 | 8/1992 |
| JP | 10119999 | 5/1996 |
| JP | 9226790 | 9/1997 |
| JP | 1107557 | 7/1998 |

* cited by examiner

TAMPER-INDICATING CLOSURE WITH LUGS ON A STOP FLANGE FOR SPACING THE FLANGE FROM THE FINISH OF A CONTAINER

This application is a division of application Ser. No. 09/301,065 filed Apr. 28, 1999, now U.S. Pat. No. 6,382,443B1.

The present invention relates to tamper-indicating closures, to methods of manufacturing such closures, and to a package that includes such a closure on a container.

BACKGROUND AND OBJECTS OF THE INVENTION

It is conventional to form a tamper-indicating closure having a band connected to the skirt of the closure by integral frangible bridges or webs. The band has a stop element (e.g., a flange or a bead) that engages a bead on the container to resist unthreading of the closure, so that removal of the closure ruptures the frangible elements that connect the band to the closure skirt. U.S. Pat. Re 33,265, assigned to the assignee hereof, discloses a tamper-indicating closure of this character, in which the tamper-indicating band is completely severed from the closure skirt and remains with the container upon removal of the closure from the container. U.S. Pat. No. 5,295,600, also assigned to the assignee hereof, discloses a tamper-indicating closure in which the tamper-indicating band remains connected to the closure skirt and is removed from the container with the closure.

Although tamper-indicating closures of the types disclosed in the noted patents have enjoyed substantial commercial acceptance and success in the art, further improvements remain desirable. In particular, problems are encountered when employing this type of closure with a container in so-called wet finish applications, in which liquid may spill during or after the filling operation onto the outside surface of the container finish so as to be disposed between the container finish and the closure skirt after capping. Wet finish situations of this type are encountered during hot-fill, cold-fill and aseptic-fill situations, in which the containers are filled close to the brim or to overflow prior to capping. Wet finish situations can also be encountered during filling operations in which liquid may drip from the filling machinery onto the container finish. In wet-finish situations of this type, problems are encountered in connection with draining and drying of the area between the outer surface of the container finish and the closure skirt—i.e., between the threads on the container finish and skirt, and around the tamper-indicating band and the stop element. Liquid trapped within this area can result in growth of mold and mildew. This drainage problem is particularly exacerbated in situations in which the self-resiliency of the closure biases the stop flange into opposed engagement with the so-called A1 diameter of the container finish. While wet finish applications are not usually recommended by closure manufacturers because of the potential for entrapment of product in the closure threads and the consumer problems that result therefrom, the present invention will help alleviate the potential for product entrapment when the product filler finds it necessary to use such a filling process.

It is a general object of the present invention to provide a closure and method of manufacture that facilitate drainage of liquid products after filling and capping the closure and container package. Another and related object of the present invention is to provide a closure and method of manufacture that achieve the foregoing objectives while retaining the advantages of the closures disclosed in the above-noted patents in terms of ease of application to the container finish after filling (lower top load and lower temperature) and whole or partial rupture of the tamper-indicating band from the closure skirt to provide the tamper-indicating feature. Yet another object of the present invention is to provide a package, which includes a closure and a container, that is particularly well adapted for use in conjunction with wet finish applications as described.

SUMMARY OF THE INVENTION

A tamper-indicating closure of integrally molded plastic construction in accordance with presently preferred embodiments of the invention includes a base wall having a peripheral skirt with internal threads for engaging external threads on a container finish. A tamper-indicating band is connected to the edge of the skirt by frangible means such as a plurality of circumferentially spaced integral frangible bridges. A stop flange extends axially outwardly and radially inwardly from an edge of the band remote from the skirt for inversion and engagement with a bead on the container finish. The stop flange is in the form of a circumferentially continuous base of uniform thickness circumferentially of the band, and either uniform or increasing thickness radially and axially of the band. A plurality of circumferentially spaced lugs are integral with and extend from the base. The lugs widen uniformly from zero thickness at the band to a maximum thickness at the free edge of the flange. The lugs are thus disposed for opposed abutting engagement with the A1 diameter of the container finish beneath the A bead on the container finish. The channels or serrations between the lugs permit drainage of liquid from the area between the skirt and the container finish.

In the preferred embodiments of the invention, the lugs are of uniform dimension circumferentially of the flange, and spacing between the lugs is of uniform dimension circumferentially of the flange. The uniform circumferential dimension of the lugs is preferably less than the uniform circumferential spacing between the lugs to enhance the area for drainage of liquid between the flange and the opposing surface of the container finish. The lugs thus serve to space the flange base from the container finish, and to strengthen the flange base upon abutting engagement with the finish A bead during removal of the closure from the container finish. The thickness of the lugs at the free edge of the flange may be either greater than or less than the thickness of the base at the free edge of the flange. Thickness of the flange base may be either uniform axially and radially of the flange, or may increase axially and radially of the flange from the band to the free edge of the flange. The free edge of the flange preferably is circumferentially continuous without scallops or indentation, and lies entirely in a plane parallel to the base wall.

In accordance with another aspect of the present invention, a package is provided that comprises a container having a finish with external threads and an external bead disposed beneath the threads, and a tamper-indicating closure that includes a base wall having a peripheral skirt with internal threads securing the closure to the container. A tamper-indicating band is connected by frangible means to an edge of the skirt, and a stop flange extends axially and radially from an edge of the band remote from the skirt. The stop flange includes a circumferentially continuous base of uniform thickness circumferentially of the band, and either uniform or increasing thickness radially and axially of the band. A plurality of circumferentially spaced lugs integrally extend from the base into opposed abutting engagement with the opposed surface of the container finish beneath the bead. The lugs widen uniformly from zero thickness at the band to a maximum thickness at the free edge of the flange. The present invention also contemplates a method of manufacturing a tamper-indicating closure of the type described in the preceding paragraph.

In accordance with yet another aspect of the present invention, a method of filling and capping a container includes the step of providing a container having a finish with external threads and an external bead, and filling the container with liquid to a brim of the finish. A closure is then applied to the container finish, with the closure having a base wall, a skirt with internal threads, a band connected to the skirt by frangible means, and a flange extending from the band for engagement with the container bead. To facilitate drainage of liquid from between the closure skirt and the container finish, the flange on the closure is provided in the form of a circumferentially continuous base of uniform thickness circumferentially of the band, and either uniform or increasing thickness radially and axially of the flange. A plurality of circumferentially spaced lugs are formed integrally with and extend from the base for abutting engagement with an opposing surface of the container finish beneath the bead. The lugs widen uniformly radially and axially of the flange from zero thickness at the band to a maximum thickness at the free edge of the flange.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
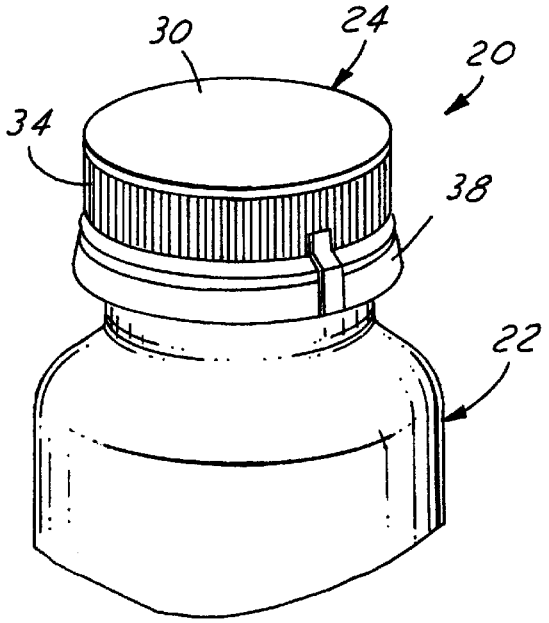
FIG. 1 is a fragmentary perspective view of a container and closure package in accordance with a presently preferred embodiment of the invention.
Figure 2:
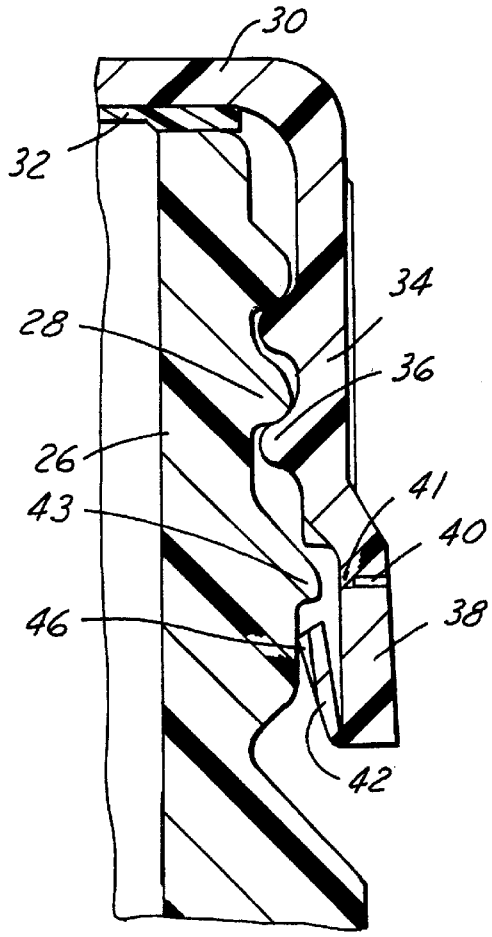
FIG. 2 is a fragmentary sectional view that illustrates the container finish and closure in the package of FIG. 1.
Figure 3:
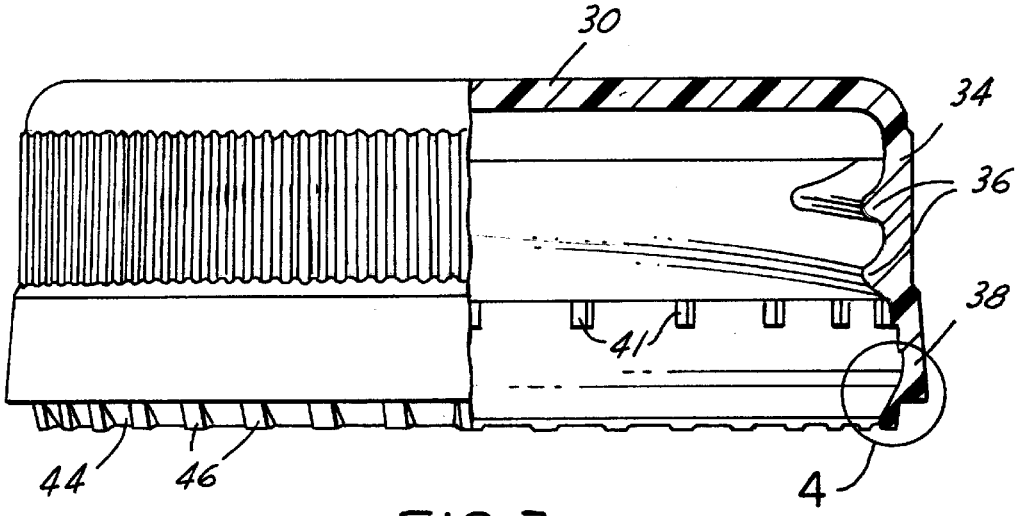
FIG. 3 is a partially sectioned side elevational view of the closure in the package of FIGS. 1 and 2 as molded—i.e., before stop flange inversion.

FIGS. 1–3 illustrate a package 20 in accordance with one presently preferred embodiment of the invention as comprising a container 22 of glass or molded plastic construction and a tamper-indicating closure 24 threaded thereon. Container 22 has an axially extending finish 26 for receiving closure 24. Closure 24 has a flat base wall 30 on which a sealing liner 32 is secured. An annular peripheral skirt 34 extends downwardly from closure base wall 30, and has an internal thread 36 for securing closure 24 over an external thread 28 on container 22. (Direction adjectives such as "downwardly" are taken with reference to the vertical orientation of the container and closure illustrated in FIGS. 1 and 2.) A tamper-indicating band 38 is secured to the lower end of skirt 34, being separated therefrom by a circumferential score 40. Tamper-indicating band 38 is coupled to closure skirt 34 by a circumferentially spaced array of frangible bridges 41 (FIGS. 2 and 3). Bridges 41 preferably are formed during the scoring operation, as described in patents referenced hereinafter. Alternatively, the bridges may be molded onto the inside surface of skirt 34 and band 38, as shown in U.S. Pat. Nos. 4,407,422 and 4,418,828. Alternatively, but less preferably, band 38 may be connected to skirt 34 by one or more thin frangible webs integrally molded with the closure. A stop flange 42 extends radially inwardly and axially upwardly (FIG. 2) from the lower end of band 38 to a position beneath a radially outwardly extending bead 43 on container 22 beneath threads 28. Bead 43 is sometimes called the container transfer bead or the A bead, referring to the fact that bead 43 defines the A dimension of the container finish.

Closure 24 may be injection molded, or may be compression molded as taught in U.S. Pat. No. 5,554,327. Liner 32 may be separately formed, or more preferably compression molded in situ within a preformed closure as disclosed in U.S. Pat. Nos. 4,984,703 and 5,451,360. U.S. Pat. Nos. 5,488,888, 5,522,293 and 5,564,319 disclose techniques for forming score 40 and bridges 41 in the scoring operation. U.S. Pat. No. 5,755,347 and Re 33,265 disclose techniques for inverting stop flange 42 from the as-molded configuration of FIG. 3 to the configuration of FIG. 2 ready for use. All patents noted herein, assigned to the assignee hereof, are incorporated herein by reference for purposes of background.

Figure 4:
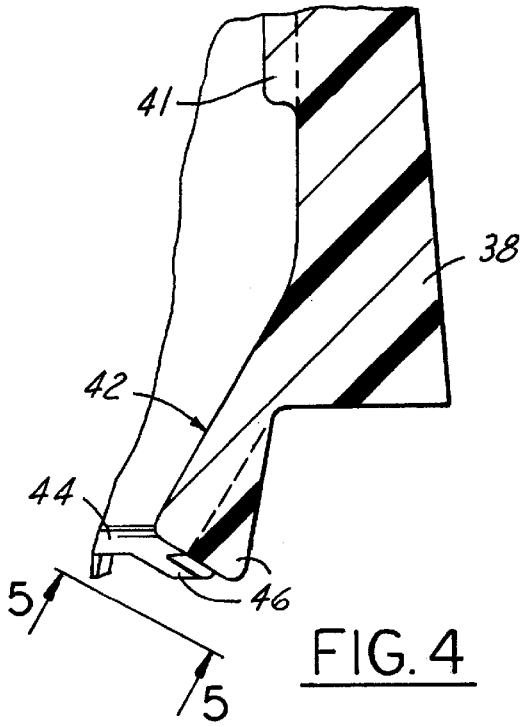
FIG. 4 is a fragmentary sectional view of the portion of the closure within the circle 4 in FIG. 3.
Figure 5:
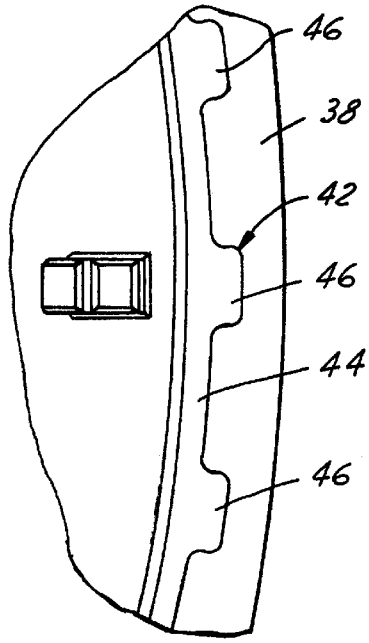
FIG. 5 is a fragmentary plan view taken from the direction 5—5 in FIG. 4.

FIGS. 3–8 illustrate closure 24 as molded—i.e., before inversion of stop flange 42, formation of score line 40 and molding of liner 32. Stop flange 42 in accordance with one aspect of the present invention comprises a circumferentially continuous base 44 on which a plurality of lugs 46 are integrally molded. Flange base 44 in the embodiment of FIGS. 1–5 is of uniform thickness both circumferentially of flange 42, and radially and axially of flange 42. Thus the radially and axially outer surface of base 44 is parallel to the radially and axially inner surface thereof, as best seen in FIG. 4. Lugs 46 are of identical and uniform circumferential dimension as best seen in FIGS. 3 and 5, and widen or thicken axially and radially of flange 42 from zero thickness at the juncture of flange 42 with band 38, to a maximum thickness at the free edge of flange 42. As best seen in FIG. 5, circumferentially spacing between lugs 46 preferably is greater than the circumferential dimension of lugs 46. Lugs 46 serve not only to space flange base 44 from the container finish as will be described, but also to strengthen the flange 42 during abutting engagement with finish bead 44 during frangible separation of band 38 from skirt 34. It is presently preferred that lugs 46 occupy minimum circumferential dimension of flange 42 consistent with this strengthening function.

As best seen in FIG. 2, following inversion of flange 42 and securement of closure 24 to container 22, lugs 46 are urged by internal resiliency of the closure material into opposed abutting engagement with the opposing surface at the so-called A1 diameter of the container finish beneath bead 44. The circumferentially spaced lugs 46 thus serve to space base 44 of flange 42 radially outwardly from the opposed container finish surface, thereby providing intervening serrations or channels for drainage of liquid that might otherwise be captured between the closure skirt and the container finish. The spaced lugs 46 thus function to form serrations or channels between the lugs for drainage of liquid.

Figure 6:
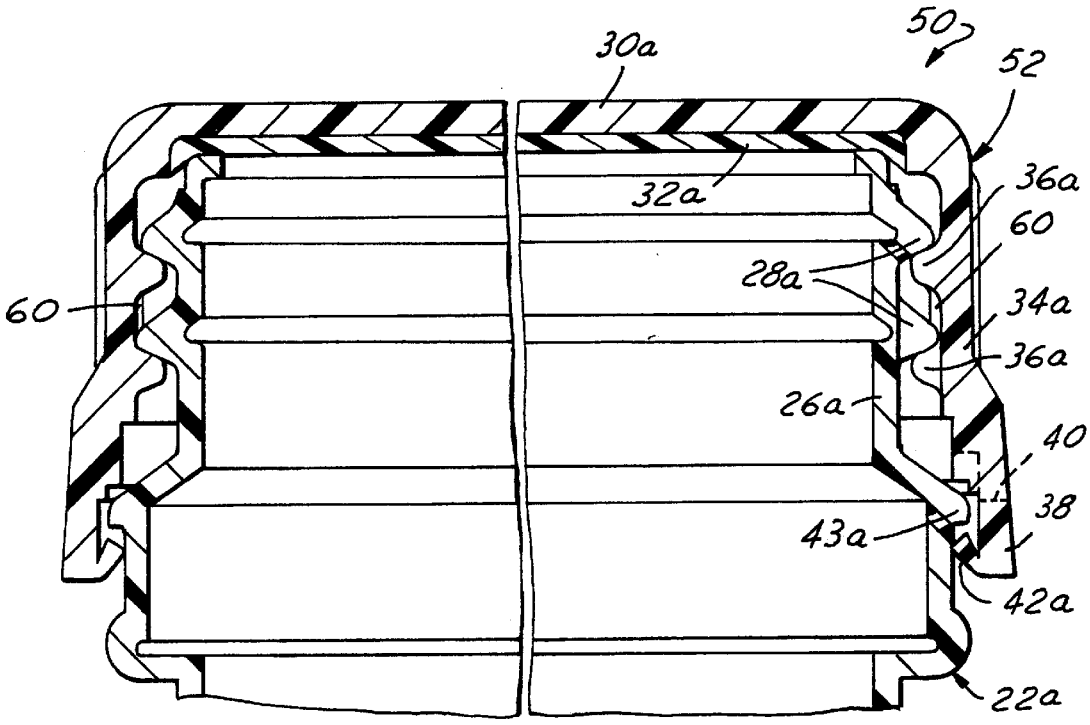
FIG. 6 is a fragmentary sectional view that bisects a closure and container finish in accordance with another embodiment of the invention.
Figure 7:
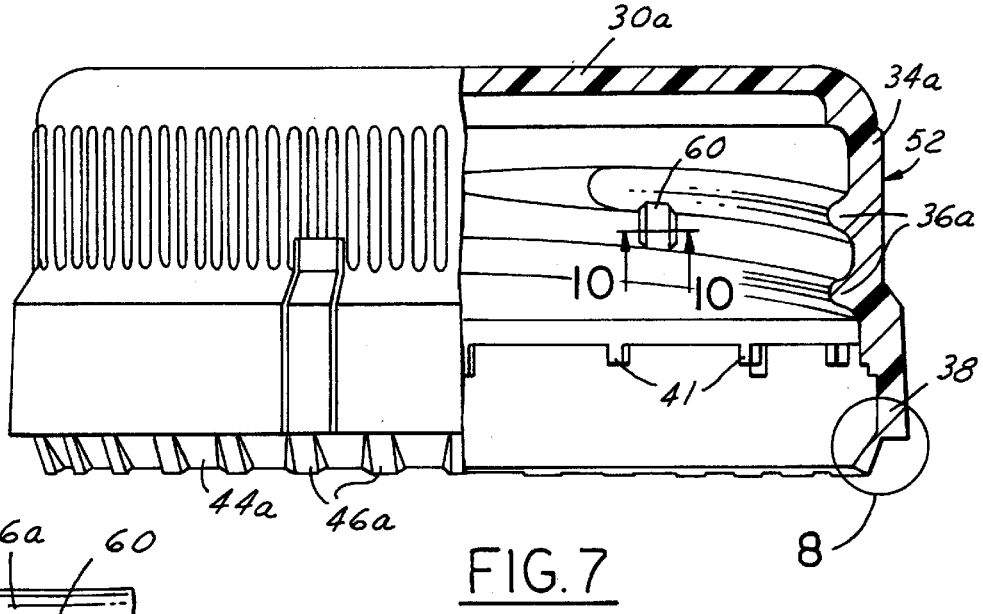
FIG. 7 is a partially sectioned side elevational view of the closure in the package of FIG. 6 as molded.
Figure 10:
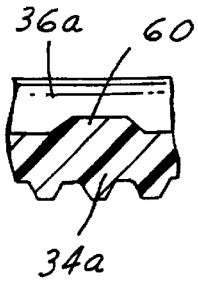
FIG. 10 is a fragmentary sectional view taken substantially along the line 10—10 in FIG. 7.
Figure 8:
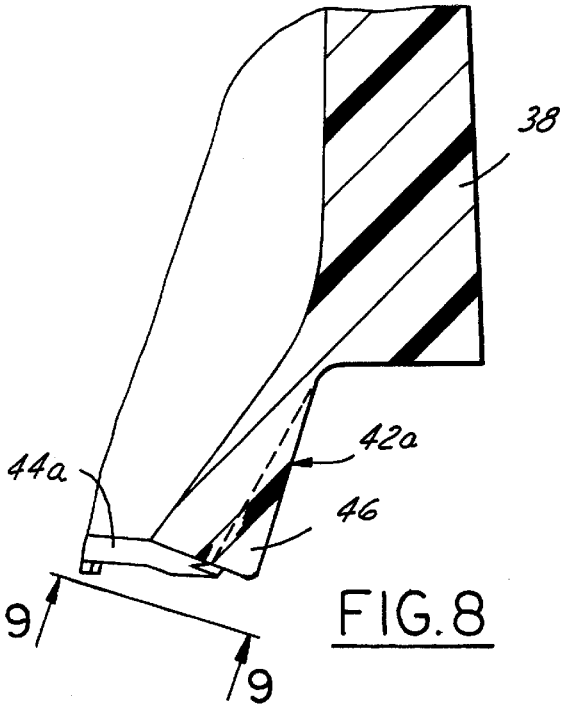
FIG. 8 is a fragmentary sectional view of the portion of FIG. 7 within the circle 8.
Figure 9:
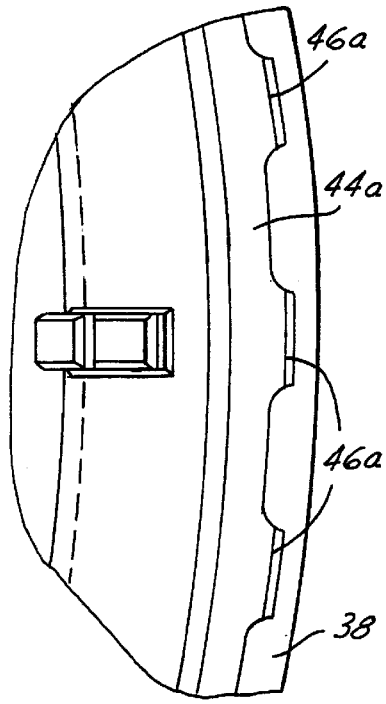
FIG. 9 is a fragmentary plan view taken from the direction 9—9 in FIG. 8.

FIGS. 6–10 illustrate a closure/container package 50 in accordance with another embodiment of the invention. Elements in FIGS. 6–10 that are identical or similar to elements in the embodiment of FIGS. 1–5 are indicated by correspondingly identical reference numerals, while modified elements are indicated by corresponding reference numerals followed by the suffix "a." Closure 52 in package 50 includes a base wall 30*a* and a peripheral skirt 34*a*. A liner 32*a* is provided on the internal surface of base wall 30*a*, preferably by compression molding in situ as previously described. Whereas liner 32 in FIG. 2 is of the type illustrated in U.S. patent application Ser. No. 08/851,821, liner 32*a* in FIG. 6 is of the type illustrated in U.S. Pat. Nos. 5,650,113 or 5,265,747. It is also contemplated in accordance with the present invention that closure 24 (FIGS. 1–5) or closure 52 (FIGS. 6–10) may be of the so-called linerless type, embodying a sealing lip as illustrated for example in U.S. Pat. No. 5,320,236. A stop flange 42*a* extends from tamper-indicating band 38 of closure 52. As best seen in FIG. 8, flange 42*a* differs somewhat from flange 42 in FIG. 4 in that flange base 44*a* is of uniform dimension circumferentially, but thickens or widens radially and axially from tamper-indicating band 38. Circumferentially spaced lugs 46*a* are of uniform and identical circumferential dimension, as are the gaps or spaces between the lugs, and thicken or widen axially and radially from band 38 to the free edge of flange 42*a*. Thus, flange 42*a* in FIGS. 6–8 is stronger than 42 in FIGS. 1–5, but the serrations or channels formed between the lugs 46*a* are of lesser radial dimension in the embodiment of FIGS. 6–10 than in the embodiment of FIGS. 1–5. In an exemplary 43 mm embodiment of the closure illustrated in FIGS. 1–5, flange base 44 has a nominal thickness of 0.014 inches and a total thickness at the free edge of flange 42 of 0.035 inches. Thus, the thickness of lugs 46 increases from zero at band 38 to about 0.021 inches at the free edge of the flange. The overall axial and radial length of flange 42 is about 0.060 inches. There are thirty-six equally spaced lugs 46 disposed around band 44 in this 43 mm closure embodiment, with each lug 46 having a circumferential dimension of 0.050 inches. In a 38 mm example of the embodiment of the invention illustrated in FIGS. 6–10, the thickness of flange base 44*a* at the juncture with band 38 is 0.010 inches, and the overall thickness at the free edge of flange 42*a* is 0.035 inches. There are thirty-two equally spaced lugs 46*a* around the circumference of flange 42*a*, with each lug having a circumferential thickness of 0.059 inches. The overall radial and axial dimension of flange 42*a* is about 0.068 inches. The thickness of flange base 44*a* at the free edge of the flange is 0.021 inches. Thus, lugs 46*a* increase from zero thickness adjacent to band 38 to about 0.014 inches at the free edge of the flange. All exemplary dimensions are nominal.

The embodiment of FIGS. 6–10 illustrates another feature or aspect of the present invention. Closure 52 is provided with a double internal thread starting 180° apart. Each thread has a circumferential dimension of 250°. A pair of diametrically opposed friction ribs 60 extend radially inwardly from the inside surface of closure skirt 34*a*, and extend axially between adjacent reaches of the internal threads 36*a*. The radial dimension of ribs 60 is less than half the radial depth of closure threads 36*a*. In the illustrated embodiment, the circumferential dimension of each rib 60 is 0.060 inches, and the radial dimension is 0.015 inches. Each rib 60 has rounded circumferential edges for camming engagement with the container threads as closure 52 is threaded onto the finish 26*a* of container 22*a*. Thus, ribs 60 help to maintain frictional engagement between the closure and the container finish as the closure is threaded onto and off of the container. This is particularly useful in conjunction with double-thread closures.

What is claimed is:

1. In a method of filling and capping a container which comprises the steps of:

(a) providing a container having a finish with at least one external thread and an external bead, (b) providing a tamper-indicating closure having a base wall, a skirt with at least one internal thread, a band connected to said skirt by frangible means, and a flange extending at an angle radially inwardly from said band and axially toward said base wall for engagement with said bead, (c) filling the container with liquid to a brim of said finish, and (d) applying the closure to the container finish such that said at least one internal thread meshes with said at least one external thread and said flange is circumferentially disposed under said external bead, the improvement for facilitating drainage of liquid from between the closure skirt and the container finish, which comprises:

(e) providing said flange in the form of a circumferentially continuous base extending from said band to a free edge of said flange and being of constant cross section circumferentially entirely around said flange, said free edge being circumferentially continuous and lying in a plane parallel to said base wall, and a plurality of circumferentially spaced lugs integral with and extending axially along said base and radially inwardly from said base, said lugs radially thickening uniformly from zero thickness adjacent to said band to a maximum thickness at a free edge of said flange.

2. The method set forth in claim 1 wherein said lugs are of identical circumferential width.

3. The method set forth in claim 2 wherein circumferential spacing between said lugs is uniform around said flange, and wherein said circumferential width of said lugs is less than said circumferential spacing between said lugs.

4. The method set forth in claim 3 wherein said base of said stop flange has a constant thickness both circumferentially and radially.

5. The method set forth in claim 4 wherein said maximum thickness of said lugs at said free edge of said flange is greater than the thickness of said base at said free edge.

6. The method set forth in claim 3 wherein said base has a thickness that increases axially and radially of said flange.

7. The method set forth in claim 1 wherein said frangible means comprises a plurality of circumferentially spaced frangible bridges.

8. The method set forth in claim 1 wherein said closure further includes a plurality of ribs extending axially between reaches of said thread for frictional engagement with said external thread on said container finish.

9. The method set forth in claim 8 wherein said at least one internal thread comprises a double thread, and wherein said plurality of ribs comprises diametrically opposed ribs.

10. The method set forth in claim 9 wherein said ribs have rounded circumferential edges.

11. The method set forth in claim 10 wherein said ribs have a radial dimension that is less than that of said threads.

12. In a method of filling and capping a container which comprises the steps of:

(a) providing a container having a finish with at least one external thread and an external bead, (b) providing a tamper-indicating closure having a base wall, a skirt with at least one internal thread, a band connected to said skirt by frangible means, and a flange extending at an angle radially inwardly from said band and axially toward said base wall for engagement with said bead, (c) filling the container with liquid to a brim of said finish, and (d) applying the closure to the container finish such that said at least one internal thread meshes with said at least one external thread and said flange is circumferentially disposed under said external bead, the improvement for facilitating drainage of liquid from between the closure skirt and the container finish, which comprises:

(e) providing said flange in the form of a circumferentially continuous base extending from said band to a free edge of said flange and being of constant cross section circumferentially entirely around said flange, said base having a thickness that increases axially and radially of said flange, and a plurality of circumferentially spaced lugs integral with and extending axially along said base and radially inwardly from said base, each of said lugs being of constant cross section circumferentially of said flange, said lugs radially thickening uniformly from zero thickness adjacent to said band to a maximum thickness at a free edge of said flange, said lugs being of identical circumferential width, circumferential spacing between said lugs and being uniform around said flange, and said circumferential width of said lugs being less than said uniform circumferential spacing between said lugs, said lugs on said stop flange being urged by resiliency in said closure into abutting engagement with an opposing surface of said finish.

13. The method set forth in claim 12 wherein said free edge is circumferentially continuous and lies in a plane parallel to said base wall.

* * * * *